US005085257A

United States Patent [19]

Smith

[11] Patent Number: 5,085,257

[45] Date of Patent: Feb. 4, 1992

[54] SUMP COVER CONTAINMENT ASSEMBLY

[76] Inventor: Philip E. Smith, 2781 Rancho Rd., Redding, Calif. 96002

[21] Appl. No.: 510,271

[22] Filed: Apr. 17, 1990

[51] Int. Cl.[5] ..... B65B 3/06; B67P 5/00

[52] U.S. Cl. ..... 141/86; 141/98; 52/19; 404/25; 220/86.1; 137/363

[58] Field of Search ..... 141/86; 220/18, 86 R, 220/254; 137/363, 364, 321; 52/19, 20, 21; 404/25, 26

[56] References Cited

U.S. PATENT DOCUMENTS 4,659,251 4/1987 Petter et al. ..... 141/86
4,706,718 11/1987 Milo ..... 141/86
4,763,806 8/1988 Podgers et al. ..... 220/86 R
4,793,387 12/1988 LeBlanc et al. ..... 141/86
4,881,579 11/1989 Sharp ..... 141/86

*Primary Examiner*—Ernest G. Cusick
*Attorney, Agent, or Firm*—Leonard D. Schappert

[57] ABSTRACT

A sump cover containment assembly is provided for use with containment sumps utilized with underground fluid holding tanks having a sump cover with an access hole therein, a frame which communicates with the containment sump to which the sump cover is attached and a sump shield positioned between the containment sump and the frame and having a hole which communicates with the interior of the containment sump as well as with the sump cover access hole.

7 Claims, 2 Drawing Sheets

SUMP COVER CONTAINMENT ASSEMBLY

BACKGROUND OF THE INVENTION

1. Field of the Invention.

The present invention is directed generally toward providing a pollution preventive device, particularly one for use in conjunction with filling and/or evacuation outlets, and more specifically to a sump cover containment assembly which minimizes the likelihood that gasoline being pumped into or out of an underground gas tank or other container will pollute surrounding soil and which minimizes the likelihood that surface water will enter the containment sump.

2. DESCRIPTION OF THE PRIOR ART

In the recent past, concern for the environment and the safety of the public with regard to chemical pollutants has increased steadily. This has become especially true as regards gasoline stations and specifically with respect to the filling and evacuating of underground gasoline tanks. It has recently become clear that, during filling and/or evacuating of underground gas storage tanks, the soil about the tanks has become contaminated and must therefore be removed. While some inventions, such as the pollution prevention devices described in U.S. Pat. No(s). 4,520,852 and 4,696,330, were directed toward devices designed to catch spills close to a fill pipe or evacuation pipe, none of the prior art of which the applicant is aware has taught a sump cover containment assembly which is capable of protecting the soil about a gas tank from spills as a result of filling or evacuating that gas tank and which includes sealing means designed to prevent water from entering the sump cover containment assembly, thereby minimizing contamination of the gas inside the gas tank.

SUMMARY OF THE INVENTION

The present invention consists of a sump cover containment assembly capable of minimizing the likelihood that gasoline spilled during the filling or evacuation of a gas tank will contaminate the ground around the gas tank and/or the ground water, as well as providing an effective shield which effectively eliminates the entry of water into the fill pipe or other possible entries to an underground gas tank. The present invention includes a sump shield sized and shaped to fit over a containment sump utilized with a gas tank. The sump shield fits down and over the top of the containment sump. The sump shield further includes upward extensions which have holes therein to provide access to the interior of the containment sump through the sump shield. The sump shield may be constructed of any material which effectively constitutes a barrier to water and/or petroleum. Polyethylene was used in the present device. A sump cover is provided which has downward extensions which are shaped and sized to mate with the upward extensions of the sump shield and which have holes therein which communicate with the upward extensions of the sump shield, thereby providing access from above the sump cover through the downward extensions of the sump cover and the upward extensions of the sump shield into the containment sump. Lids are provided to seal the holes in the sump cover in order to effectively eliminate entry of water into the containment sump from the surface of the ground. As a result of the sealed lids in the sump cover and the use of a sump cover shield as taught herein, both the entry of surface water into the gas tank and the intrusion of gas into the soil surrounding the gas tank is minimized.

One of the objects of the present invention is to provide a sump cover containment assembly which minimizes the likelihood of water intrusion into the gas tank from the surface.

Another object of the present invention is to provide a sump cover containment assembly which minimizes the likelihood that gas spills occurring during filling the gas tank will intrude into the soil surrounding a gas tank.

Another object of the present invention is to provide a new sealing lock unit which is capable of self-sealing while holding the sump cover in position over a containment sump.

The foregoing objects, as well as other objects and benefits of the present invention, are made more apparent by the descriptions and claims which follow.

DESCRIPTION OF THE PREFERRED EMBODIMENTS

Figure 1:
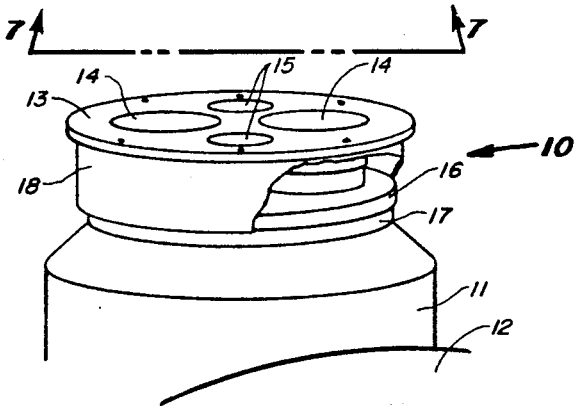
FIG. 1 is a perspective view of the sump cover containment assembly.

The present invention consists of a sump cover containment assembly 10 as shown in FIG. 1 of the drawings. The sump cover containment assembly 10 includes a frame 18, a sump shield 16 and a sump cover 13 positioned atop the frame 18 and communicating with the sump shield 16. The containment sump 11 with which the sump cover containment assembly 10 communicates is positioned atop and attached to a gas tank 12 as here shown. Containment sump 11 has an extension 17 extending upward therefrom which communicates with sump shield 16. As will be seen in FIG. 7 of the drawings, the containment sump 11 is hollow and, while the containment sump 11 and sump cover containment assembly 10 are both shown shaped substantially cylindrically, they might be shaped elliptically, squarely or in any other geometric configuration which would be practicable. Sump cover 13 may include one or more lids 14 and 15 to facilitate entry into containment sump 11. Sump cover 13 is positioned atop a frame 18 and is lockable with respect thereto. The gas tank 12 and containment sump 11 here shown are normally positioned below ground level; therefore, the frame 18, which is designed to extend about extension 17 of containment sump 11, may be positioned and set in concrete or any other effective rigid positioning means. The top of frame 18 may be set at ground surface level, positioning the sump cover 13 just above ground level.

Figure 2:
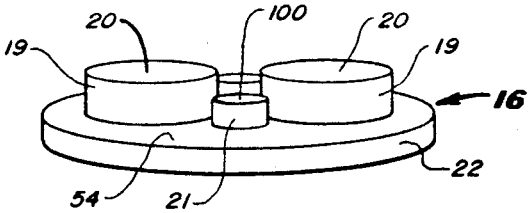
FIG. 2 is a perspective view of the sump shield used with the sump cover containment assembly.
Figure 7:
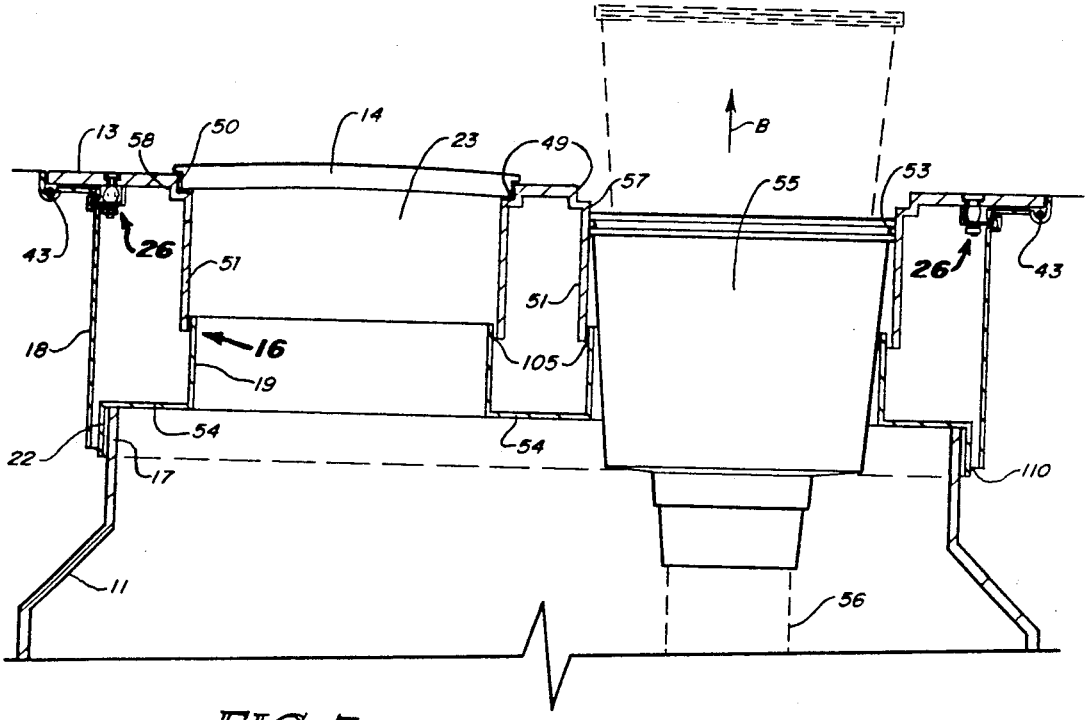
FIG. 7 is a cross-sectional view of the sump cover containment assembly taken along line 7—7 of FIG. 1 of the drawings.

FIG. 2 of the drawings illustrates the structure of sump shield 16. Sump shield 16 may be constructed with a base 54 having a downward circumferential lip 22 extending downward therefrom, extending completely around base 54 and sized, shaped and oriented to fit down over extension 17 of containment sump 11 as shown in FIG. 1. Sump shield 16 also has upward extensions 19 and 21 which are provided to communicate with downward-extending sleeves 51 as shown in FIG. 7 of the drawings. Holes 20 in upward extensions 19 provide communication between downward extending sleeves 51 of sump cover 13 and the interior of containment sump 11. When upward extension 21 is utilized, a hole 100 provides communication from sump cover 13 to containment sump 11. In practice, one or more upward extensions 19 and/or 21 may be provided to facilitate access for filling and/or evacuation of pipes or instrumentation.

Figure 3:
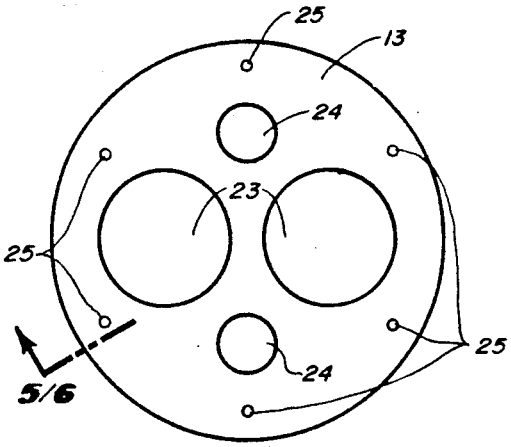
FIG. 3 is a top view of the sump cover utilized with the sump cover containment assembly.

FIG. 3 is a top view of sump cover 13. Sump cover 13 has access holes 23 and 24 to provide access to the interior of sump cover containment assembly 10. Lids 14 and 15 fit over access holes 23 and 24 as shown in FIG. 1 of the drawings. Sump cover 13 also includes multiple holes 25 through which the threaded section 28 of sealing lock unit 26 may be positioned to lock down sump cover 13 against frame 18.

Figure 4:
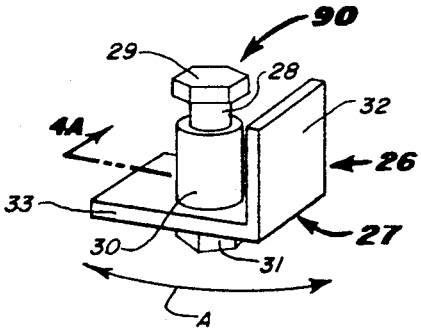
FIG. 4 is a perspective view showing the construction of the sealing lock unit utilized in sealing the sump cover in position above the containment sump.
Figure 5:
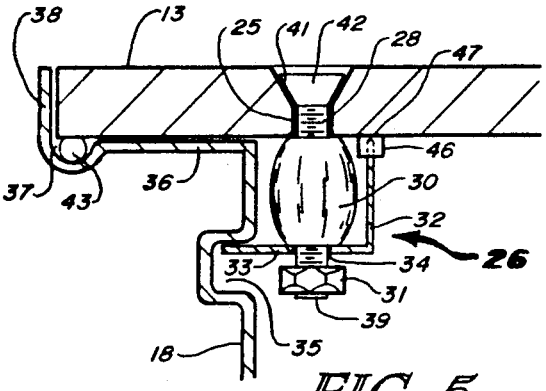
FIG. 5 is a cross-sectional view taken along line 5/6 of FIG. 3 of the drawings showing how the sealing lock unit of FIG. 4 is utilized in holding the sump cover down.
Figure 6:
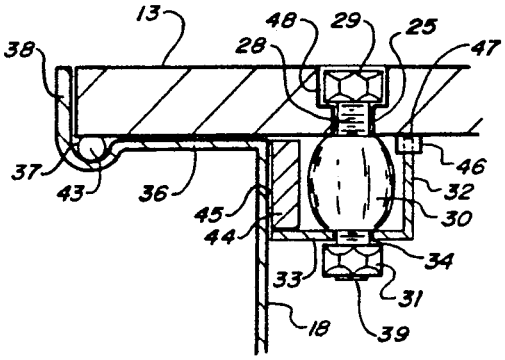
FIG. 6 is a cross-sectional view taken along line 5/6 of FIG. 3 showing an alternative method of utilizing the sealing lock unit to hold down the sump cover.

The sealing lock unit 26 as shown in FIG. 4 is utilized to hold sump cover 13 against frame 18 as shown in FIGS. 5 and 6. Sealing lock unit 26 consists of a lock brace 27 having a vertical section 32 and a horizontal section 33, together with a bolt 90 consisting of a threaded section 28 and a head 29 extending through a threaded hole 34 therein. A flexible expandable sleeve 30, which may be constructed of rubber or any other acceptable flexible, expandable material, is fitted over threaded section 28 so that, as threaded section 28 is turned down through the threaded hole 34 in horizontal section 33, flexible expandable sleeve 30 is compressed to the condition as shown in FIGS. 5 and 6 of the drawings to seal hole 25 of sump cover 13 through which threaded section 28 extends. A nut 31 is provided to prevent bolt 90 from coming out of lock brace 27.

Figure 4A:
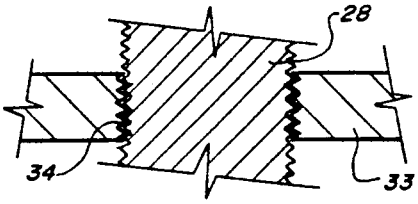
FIG. 4A is a cross-sectional view of a portion of the sealing lock unit of FIG. 4 taken along line 4A.

FIG. 4A further illustrates by use of a cross-sectional view taken along line 4A of FIG. 4 that horizontal section 33 of lock brace 27 has a threaded hole 34 therein which mates to the threads of threaded section 28 of bolt 90 which passes therethrough.

FIGS. 5 and 6 are cross-sectional views of a portion of sump cover 13 taken along line 5/6 and showing how sealing lock unit 26 is utilized to lock down sump cover 13 against frame 18 of FIG. 1. FIG. 5 shows one variation of frame 18, while FIG. 6 shows a different variation of frame 18. Frame 18 has a circumferential horizontal extension 36 which includes a circumferential groove 37 and a substantially vertically oriented cylindrical extension 38. Sump cover 13 fits into the recess created by substantially vertical cylindrical extension 38 and circumferential horizontal extension 36 as shown. Sealing means 43 is provided to seal the perimeter of sump cover 13 to frame 18. Sealing means 43 may consist of an o-ring or any other effective sealing material such as silastic, rubber or other sealing materials which are petroleum and water-resistant. Frame 18 may have an interior annular groove 35 as shown in FIG. 5 into which the end of horizontal section 33 of lock brace 27 fits when locked into position. Hole 25 is provided in sump cover 13 to facilitate insertion of threaded section 28 of bolt 90 therethrough. Hole 25 may include a counter sink 41 to facilitate use of a bolt 90 with a counter sink-type head 42, as shown in FIG. 5, or may include a counter sink 48 as shown in FIG. 6 to facilitate use of a bolt 90 having a hex head 29 as shown. During the assembly of sump cover 13 with sealing lock unit 26, nut 31 is removed from the end of threaded section 28 of bolt 90 and threaded section 28 is removed from threaded hole 34 of horizontal section 33 and from flexible expandable sleeve 30. Once threaded section 28 of bolt 90 is fed through hole 25 of sump cover 13, it may be fed through flexible expandable sleeve 30 and threaded into threaded hole 34 of horizontal section 33 of sealing lock unit 26. Then nut 31 may be threaded onto the end of threaded section 28. In order to prevent loosening, nut 31 can be permanently secured to threaded section 28 by securing means 39 such as welding or spreading of the end of threaded section 28. When sump cover 13 is placed atop frame 18, bolts 90 are turned to orient the sealing lock unit 26 to facilitate proper positioning of sump cover 13 on frame 18. Once sump cover 13 is in position, bolt 90 may be turned until the vertical section 32 of lock brace 27 is stopped and held in position by restraint 46. Restraint 46 is attached to the bottom of sump cover 13 by means of attaching means 47 such as a weld and is positioned so that, when bolt 90 is turned to position vertical section 32 against restraint 46, horizontal section 33 of lock brace 27 is held in position in interior annular groove 35 of frame 18 as shown in FIG. 5 or beneath restraint 44 as in the case of FIG. 6. As shown in FIGS. 5 and 6, frame 18 can be constructed with an interior annular groove 35 or with a restraint 44. When restraint 44 is utilized, it may be attached to the interior of frame 18 by attaching means 45 such as a weld. Restraint 44 may be constructed utilizing individual restraints for each sealing lock unit 26 or may be constructed as a ring which fits to the interior of frame 13.

FIG. 7 is a cross-sectional view of the sump cover containment assembly 10 taken along lines 7—7 of FIG. 1 and showing how the sump shield 16, sump cover 13 and other components fit together with containment sump 11. Containment sump 11 has an extension 17 which extends upward into a downward circumferential lip 22 of sump shield 16. Sump cover 13 is set in position atop frame 18 and locked into position with sealing lock unit 26 as shown. Sump cover 13 is sealed to frame 18 by flexible seal means 43 such as an o-ring. Sump cover 13 also has downward extending sleeves 51 which are sized, shaped and oriented to mate with upward extensions 19 of sump shield 16. Sump cover 13 also has holes 23 and 24 as shown in FIG. 3 of the drawings which provide alternative access to sump cover containment assembly 10. Holes 23 and 24 in sump cover 13 can include a recessed area 49 as here shown. A spill collector 55 such as that taught in U.S. Pat. No 4,696,330 may be positioned as shown and removed along arrow B. When properly positioned, spill collector 55 communicates with pipe 56 to fill gas tank 12. Such a device includes sealing means 53 such as an o-ring, which prevents intrusion of ground water between the perimeter thereof and downward extending sleeve 51. Lids 14 fit into recessed areas 49 and include sealing means 50 such as an o-ring. If additional sealing is desired, sealing means 105 and 110 may be utilized as sown. As a practical matter, a flexible rubber material such as silastic rubber may be utilized in preparing sealing means 105 and 110.

Figure 8:
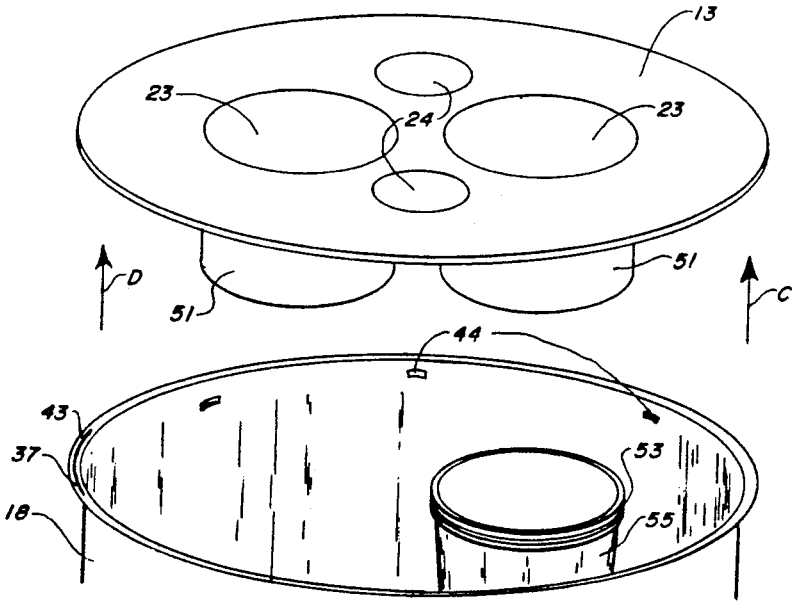
FIG. 8 is a perspective view showing how the sump cover fits on the frame of the sump cover containment assembly.

FIG. 8 of the drawings is a perspective view illustrating how sump cover 13 fits onto frame 18 of sump cover containment assembly 10. Spill collector 55 is shown in position with sump cover 13 removed Sump cover 13 may have one or more access holes 23 and 24 as desired for the particular application. Downward extending sleeves 51 mate with upward extensions 19 of sump shield 16 as shown in FIG. 7 of the drawings, as well as mating with spill collector 55. Spill collector 55 is shown with sealing means 53 such as a circumferential o-ring in position thereon to prevent petroleum from spilling between spill collector 55 and downward extending sleeve 51 of sump cover 13. The structure of frame 18 is also shown in greater detail, specifically showing individual restraints 44. The circumferential groove 37 is also shown in greater detail, showing the positioning therein of flexible seal means 43 such as an o-ring to prevent intrusion of surface water into containment sump 11. Sump cover 13 may be removed from frame 18 as shown by arrows C and D. During installation of sump cover containment assembly 10, the containment sump 11 lo should be set a considerable distance below the finished concrete or other material which is used in finishing the surface above it. Such positioning allows frame 18 to overlap extension 17 of containment sump 11 and facilitates proper positioning of sump shield 16 to effectively eliminate water intrusion into containment sump 11. When sump cover containment assembly 10 of the present invention is properly installed, contamination of the soil about the gas tank on which the sump cover containment assembly 10 is utilized is effectively eliminated, but intrusion of surface water into the containment sump 11 and gas tank 12 is also effectively eliminated.

While the foregoing description of the invention has shown preferred embodiments using specific terms, such description is presented for illustrative purposes only. It is applicant's intention that changes and variations may be made without departure from the spirit or scope of the following claims, and this disclosure is not intended to limit applicant's protection in any way.

I claim:

1. A sump cover containment assembly for use with a containment sump which has a top end with a hole therein, comprising:

a substantially hollow frame having an open top end and an open bottom end sized, shaped and oriented so that said bottom end fits around said top end of said containment sump;

a sump cover positionable over said top end of said frame, having at least one downward extension and at least one access hole extending through said at least one downward extension, said at least one access hole being of proper size, shape and orientation to facilitate positioning of a spill collector therein;

a lid for covering each of said at least one access holes in said sump cover;

first sealing means for sealing said lid to said sump cover;

second sealing means for sealing said sump cover to said frame to minimize intrusion of surface water into said substantially hollow frame, and a sump shield substantially covering said top end of said containment sump, having a downward lip which extends downward about said containment sump between said frame and said containment sump, and an upward extension having a hole therein sized, shaped and oriented to mate with said at least one downward extension of said sump cover and to facilitate positioning of said spill collector therein.

2. The invention of claim 1, including third sealing means for restraining liquid positioned in said at least one access hole of said sump cover from entering soil around said containment sump.

3. The invention of claim 2, wherein said third sealing means includes an o-ring.

4. The invention of claim 1, including locking means for locking said sump cover to said frame.

5. The invention of claim 4, including fourth sealing means for sealing said locking means to said sump cover.

6. The invention of claim 1, wherein said sump cover includes a recess extending about said at least one access hole and wherein said first sealing means consists substantially of an o-ring.

7. The invention of claim 1, wherein said second sealing means includes an o-ring positioned between said sump cover and said frame.

* * * * *